US011760100B2

(12) United States Patent
Shimizu

(10) Patent No.: US 11,760,100 B2
(45) Date of Patent: Sep. 19, 2023

(54) PRINTING APPARATUS, PRINTING CONTROL METHOD, AND STORAGE MEDIUM

(71) Applicant: CASIO COMPUTER CO., LTD., Tokyo (JP)

(72) Inventor: Daisuke Shimizu, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 32 days.

(21) Appl. No.: 17/580,164

(22) Filed: Jan. 20, 2022

(65) Prior Publication Data

US 2022/0227136 A1 Jul. 21, 2022

(30) Foreign Application Priority Data

Jan. 21, 2021 (JP) ..... 2021-007682

(51) Int. Cl.
*B41J 2/175* (2006.01)
*B05C 11/10* (2006.01)

(52) U.S. Cl.
CPC ..... *B41J 2/17503* (2013.01); *B05C 11/10* (2013.01)

(58) Field of Classification Search
CPC .... B41J 2/175; B41J 2/17503; B41J 2/17506; B41J 2/17509; B41J 2/1752; B41J 29/02; B41J 29/38; B05C 11/10
See application file for complete search history.

(56) References Cited

FOREIGN PATENT DOCUMENTS

| | | | | |
|---|---|---|---|---|
| CN | 107538923 | * | 1/2018 | ..... B41J 2/175 |
| JP | H09-309212 | A | 12/1997 | |
| JP | 2007-160716 | A | 6/2007 | |
| JP | 2009-179019 | A | 8/2009 | |
| JP | 2011-126114 | A | 6/2011 | |
| JP | 2011-143383 | A | 7/2011 | |
| JP | 2013-176939 | A | 9/2013 | |
| JP | 5471358 | B2 | 4/2014 | |

OTHER PUBLICATIONS

JPO; Application No. 2021-007682; Notice of Reasons for Refusal dated Feb. 21, 2023.

* cited by examiner

*Primary Examiner* — Anh T Vo
(74) *Attorney, Agent, or Firm* — Fitch, Even, Tabin & Flannery LLP

(57) ABSTRACT

A printing apparatus includes the following. A carriage is capable of holding at least one tank containing ink and performs printing in a printing area in the apparatus. A driver moves the carriage between at least the printing area and a stirring area provided outside the printing area. A stirrer is provided in the stirring area and is capable of stirring the ink in the tank. The stirrer is in a fastened state with the carriage in response to the driver moving the carriage to the stirring area, and stirs the ink in the tank in the fastened state.

10 Claims, 9 Drawing Sheets

PRINTING APPARATUS, PRINTING CONTROL METHOD, AND STORAGE MEDIUM

CROSS-REFERENCE TO RELATED APPLICATIONS

This application is based upon and claims the benefit of priority under 35 USC 119 of Japanese Patent Application No. 2021-007682 filed on Jan. 21, 2021, the entire disclosure of which, including the description, claims, drawings, and abstract, is incorporated herein by reference in its entirety.

BACKGROUND

1. Field of the Invention

The present invention relates to a printing apparatus, a printing control method, and a storage medium.

2. Description of the Related Art

Conventionally, the ink used in printing is a mixture of various solutes dissolved in solvents such as water, and the solutes dissolved evenly throughout the solvent or a state close to the above is the originally assumed state in use.

For example, according to a printing apparatus (nail print apparatus) in which a design is printed on a nail of a finger or the like, a base layer which is white or the like is formed on the surface of the nail before the nail design is printed on the nail so that the finish is not influenced by the color of the nail, and the design has beautiful color. The base ink such as white applied as the base includes as a white color component solutes with a large specific gravity and such components tend to settle. Examples of such solutes include titanium dioxide.

If printing is performed using ink in which sedimentation of solutes progressed, printing results may include uneven colors due to unevenness in ink density, or horizontal streaks, or problems such as clogging of a nozzle may occur and the ink may not be discharged normally. The above situations may cause decrease in the quality of printing.

As a method to stir ink and solve the sedimentation state, there is a method such as manually shaking a tank where the ink is contained. However, the method of shaking and the degree of force is different for each person. Therefore, the stirring may not be enough or the stirring may be performed too much and bubbles may occur in the tank. Moreover, it is hard labor and a burden for the user to stir ink with the hand.

In this regard, Japanese Patent No. 5471358 describes a configuration in which a carriage which holds and moves a print head (recording head in Japanese Patent No. 5471358) includes a stirrer (shaking mechanism in Japanese Patent No. 5471358), and the ink is suitably shaken and stirred.

According to the above, the stirring can be performed stably without using the user's hands, and even ink which includes solutes with large specific gravity such as base ink can be maintained at a state so that printing with high quality can be performed.

BRIEF SUMMARY OF THE INVENTION

A printing apparatus includes, a carriage which is capable of holding at least one tank containing ink and which performs printing in a printing area in the apparatus; a driver which moves the carriage between at least the printing area and a stirring area provided outside the printing area; and a stirrer which is provided in the stirring area and which is capable of stirring the ink in the tank, wherein, the stirrer is in a fastened state with the carriage in response to the driver moving the carriage to the stirring area, and stirs the ink in the tank in the fastened state.

DETAILED DESCRIPTION OF THE INVENTION

Embodiments of the printing apparatus, the printing control method, and the storage medium according to the present invention is described with reference to FIG. 1 to FIG. 14D.

The embodiments described below include various limitations technically preferable to implement the present invention. However, the scope of the present invention is not limited to the following embodiments and illustrated examples.

According to the embodiments described below, the printing apparatus is a nail print apparatus in which a target of printing is fingernails of hands and the printing is performed on the fingernails of the hands. However, the target on which printing is performed by the printing apparatus according to the present embodiment is not limited to fingernails of the hand, and for example, the target of printing may be fingernails of a foot. Alternatively, the target of printing may be a target other than nails, examples including a nail tip or a surface of various accessories.

Figure 1:
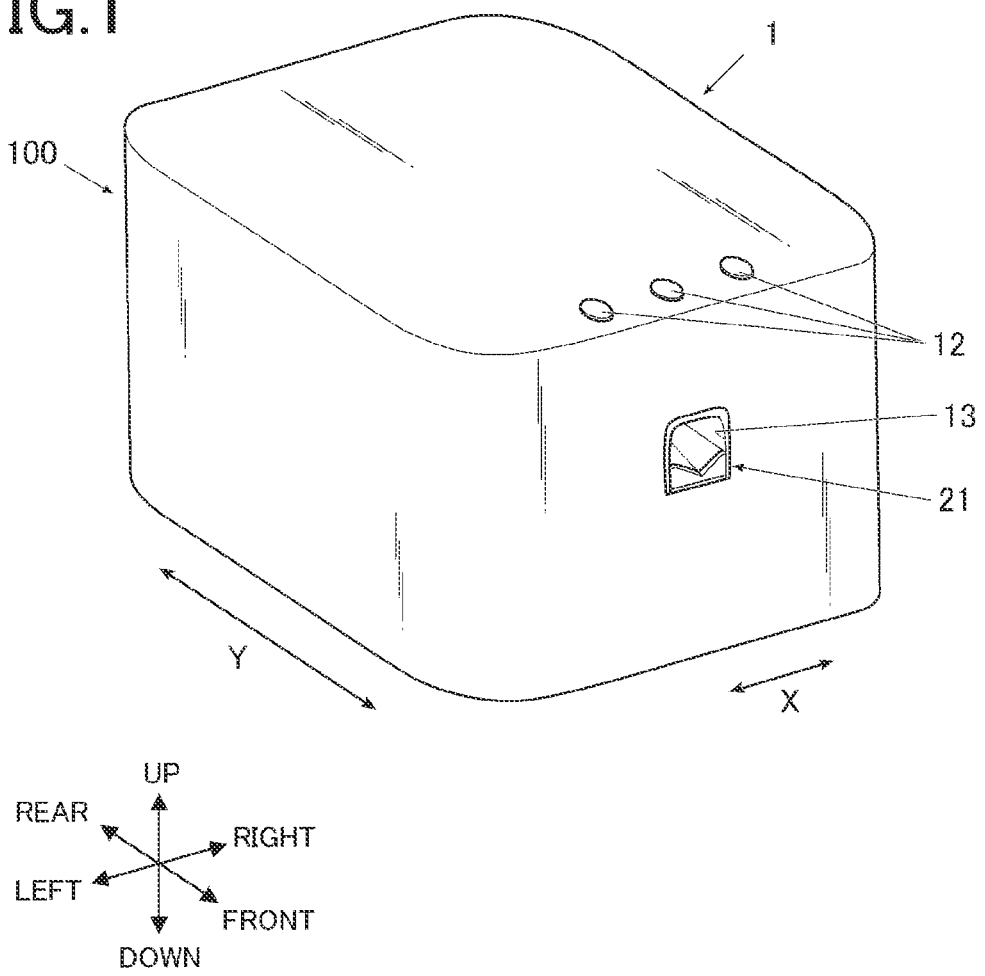
FIG. 1 is a perspective view showing an external appearance of a main portion of a printing apparatus according to the present embodiment.
Figure 2:
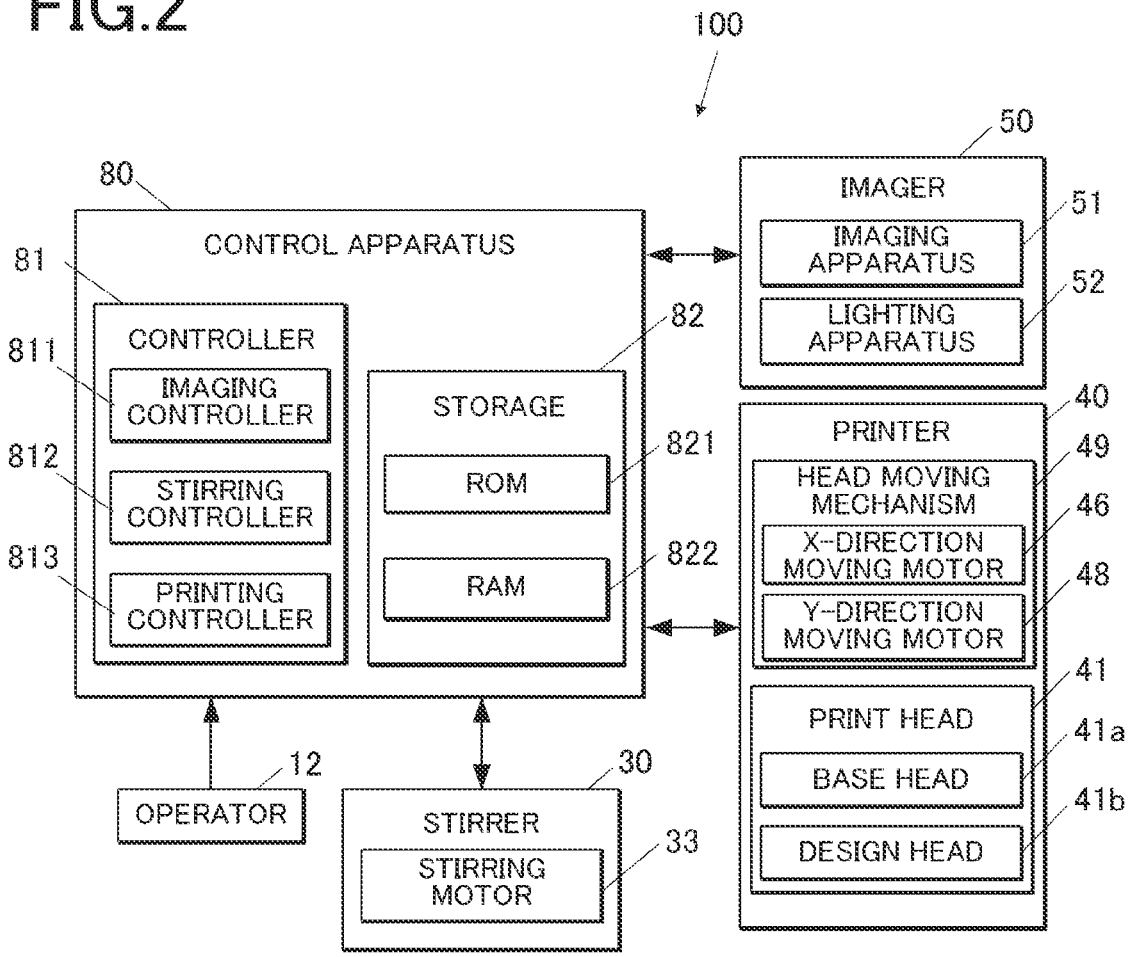
FIG. 2 is a control block diagram showing a general control configuration of the printing apparatus according to the present embodiment.

FIG. 1 is a perspective view showing an outer appearance of a main portion of the printing apparatus (nail print apparatus) according to the present embodiment. FIG. 2 is a block diagram showing a control configuration of the main portion of the printing apparatus.

In the description of the embodiments below, up, down, left, right, front, and rear are directions shown in FIG. 1. Moreover, X-direction and Y-direction are directions shown in FIG. 1.

According to the present embodiment, as shown in FIG. 1, the printing apparatus 100 includes a case 1 formed in a substantial box shape.

An operator 12 is provided on an upper surface (top plate) of the case 1.

The operator 12 is a unit with which the user performs various inputs.

The operator 12 includes various operation buttons to perform various inputs. Examples may be, a power supply switch button to turn on and turn off the power of the printing apparatus 100, a stop switch button to stop the operation, a print start button to instruct the start of printing, and the like.

When the operator 12 is operated, an operation signal according to the operation is output to the control apparatus 80. The control apparatus 80 performs control according to the operation signal and operates each unit of the printing apparatus 100.

A finger insertion opening 13 which is an opening where a finger is inserted during printing by the printing apparatus 100 is formed on a front surface side (close side in a Y-direction in FIG. 1) of the case 1 of the printing apparatus 100 and in substantially the center in a left/right direction (X-direction in FIG. 1) of the apparatus.

The apparatus main body 2 is provided inside the case 1.

Figure 3:
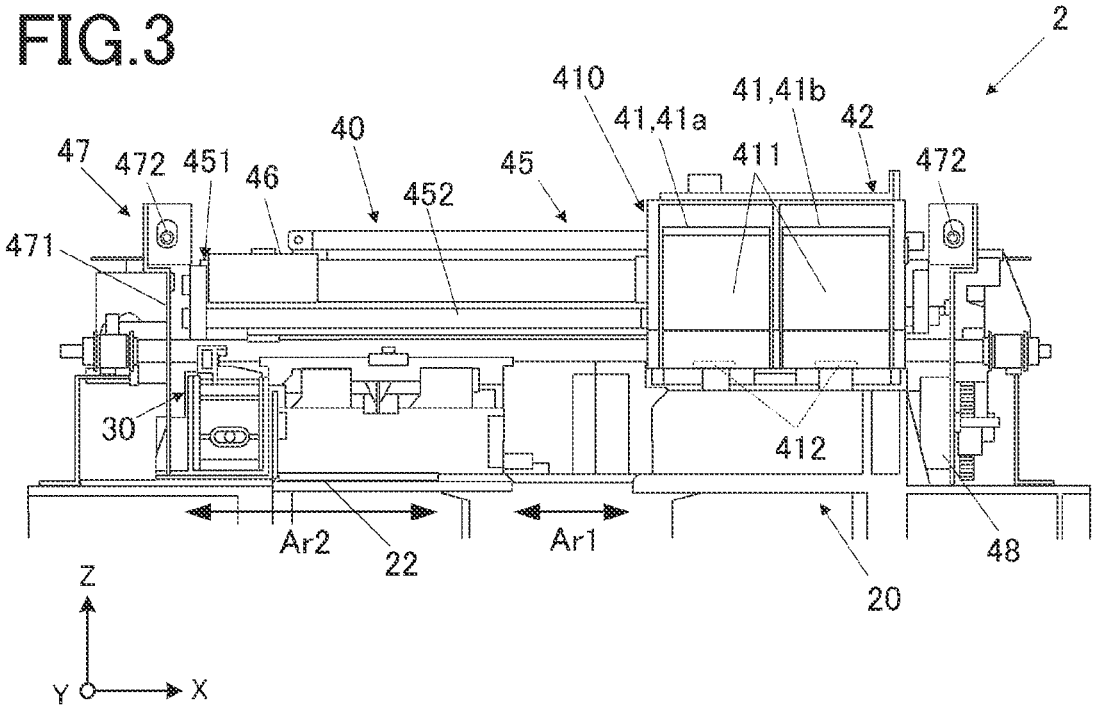
FIG. 3 is a front view of a main portion of an apparatus main body according to the present embodiment.
Figure 4:
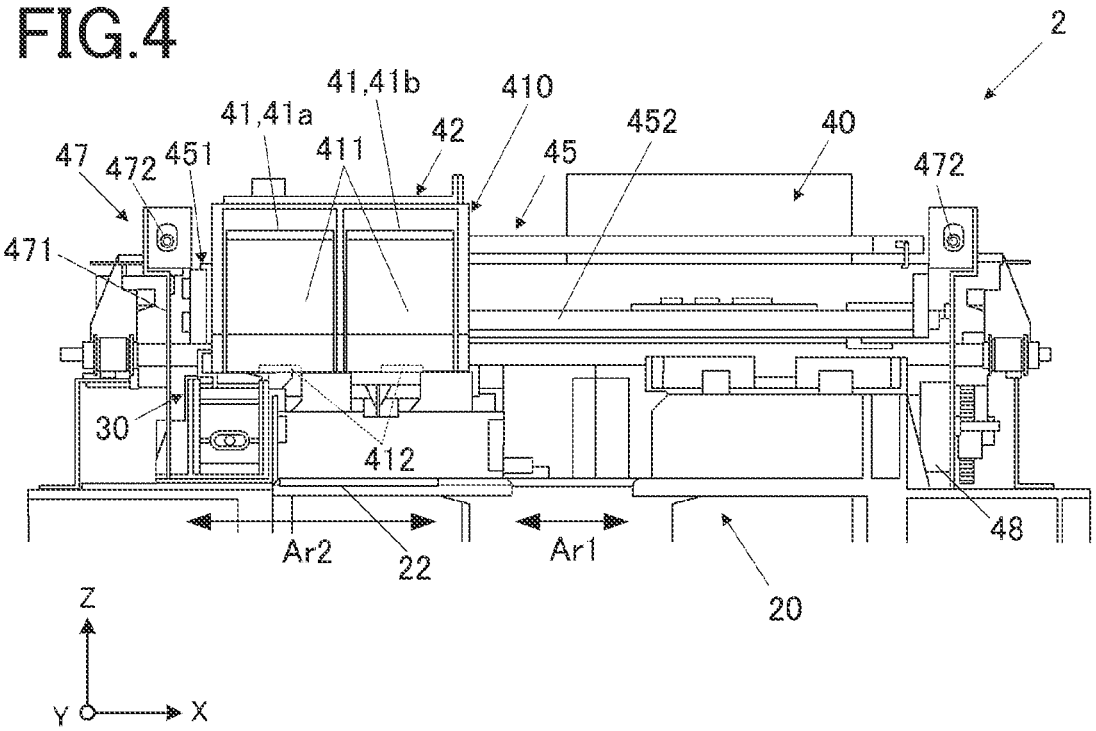
FIG. 4 is a front view of a main portion of the apparatus main body according to the present embodiment.

FIG. 3 and FIG. 4 are front views viewing the apparatus main body from the front side of the apparatus.

As shown in FIG. 3 and FIG. 4, the apparatus main body 2 includes a base 20, a printer 40 assembled on the base 20, a stirrer 30 (see FIG. 10), and the like. In addition to the above, an imager 50 is provided inside the case 1 (see FIG. 2).

A finger placer 21 is provided on the base 20 in a portion corresponding to the finger insertion opening 13. The finger placer 21 is where the finger (finger corresponding to the nail as a printing target) inserted from the finger insertion opening 13 is placed and held.

The portion where the finger placer 21 is provided (area which is substantially center in the X-direction and to the close side of the apparatus) is a printing area Ar1 in which printing is performed by the later-described printer 40.

A stirring area Ar2 in which ink is stirred by the later-described stirrer 30 is provided in an area in the apparatus outside of the printing area Ar1 (area which is a left side edge in the X-direction and to the close side of the apparatus according to the present embodiment). According to the present embodiment, as shown in FIG. 3 and FIG. 4, the area on the base 20 at the left side edge in the X-direction and to the close side of the apparatus is to be the stirring area Ar2.

An ink receiver 22 is provided on the base 20 in the stirring area A2. The ink receiver 22 receives drops of ink (including ink drops and ink in a mist form) generated from a discharger 412.

The ink receiver 22 according to the present embodiment functions as a maintenance section that performs maintenance of a print head 41. The configuration of the ink receiver 22 is not limited, and preferably, the configuration includes a material that absorbs ink.

In an area on the base 20 other than the printing area Ar1 and the stirring area Ar2 (for example, area in the rear of the apparatus), a standby area (home position) in which the print head 41 is kept in a standby state when printing is not performed, and a maintenance area in which maintenance of the print head 41 is performed (both not shown) may be provided.

The printer 40 includes the print head 41 and a head movement mechanism 49 (see FIG. 2) as a driver.

The print head 41 includes a tank 411 in which ink is contained and the discharger 412.

According to the present embodiment, the print head 41 includes a base head 41 (41*a*) in which base ink that includes a solute such as titanium oxide as a white component and that is for forming a base that is white, etc. (white or pink, blue, etc. that are close to white) on the nail before printing the design is contained in the tank 411 and a design head 41 (41*b*) in which design ink in colors such as cyan (C), magenta (M), yellow (Y), and the like is contained in the tank 411 in order to print the nail design.

When printing on the fingernails, by applying the base ink on the nail before printing the nail design using the design ink, the color of the design ink can be enhanced, and printing (nail print) with a beautiful finish can be performed.

Moreover, by including both the base head 41*a* and the design head 41*b*, it is possible to automatically perform the process from applying the base to printing the nail design with one printing apparatus 100.

When the description simply refers to the print head 41 in the description of the present embodiment, both the base head 41*a* and the design head 41*b* are included.

The discharger 412 includes a plurality of nozzle openings (not shown) that discharge ink and that are provided on a surface facing the nail surface. The discharger 412 discharges the ink contained in the tank 411. The method of how the discharger 412 discharges ink is not limited. For example, the discharger 412 is an inkjet-type discharger that forms fine droplets of ink and that directly sprays ink from the nozzle opening onto the nail surface which is the printed surface of the printed target (nail). With this, the printing is performed. The print head 41 (base head 41*a* and design head 41*b*) allows the discharger 412 to discharge ink in the printing area Ar1 and performs the printing.

According to the present embodiment, the print head 41 (base head 41*a* and design head 41*b*) is an on-carriage type print head in which the tank 411 and the discharger 412 are formed as one as a cartridge, and the above is mounted on a later-described holder 42 as one.

Specifically, the print head 41 (base head 41*a* and design head 41*b*) including the tank 411 and the discharger 412 formed as one is held in the holder 42, and the above moves on a frame 451 by a head movement mechanism 49.

According to the present embodiment, the print head 41 is able to move on the base 20 in the X-direction and the Y-direction. The head movement mechanism 49 includes an X-direction movement mechanism 45 that moves the print head 41 in the X-direction and a Y-direction movement mechanism 47 that moves the print head 41 in the Y-direction.

As shown in FIG. 3 and FIG. 4, the X-direction movement mechanism 45 includes a frame 451, an X-direction movement motor 46, and the like.

The Y-direction movement mechanism 47 includes a supporter 471 assembled on the base 20, a Y-direction guide axis 472 that is attached to the supporter 471 and that is provided in the left and the right in the X-direction to be parallel, and the Y-direction movement motor 48.

The left and right ends of the frame 451 in the X-direction are each attached to the Y-direction guide axes 472 on the left and the right. By operating the Y-direction movement motor 48, the frame 451 moves in the Y-direction along the Y-direction guide axis 472.

The head movement mechanism 49 including the X-direction movement motor 46 and the Y-direction movement motor 48 is a driver that moves at least the tank 411. The head movement mechanism 49 as the driver is configured to be able to move the tank 411 (later described carriage 410 that is able to hold the tank 411) to the stirring area Ar2.

An X-direction guide axis 452 is provided along the X-direction in the frame 451 included in the X-direction movement mechanism 45. A movement guide 44 is attached to the X-direction guide axis 452.

Figure 5:
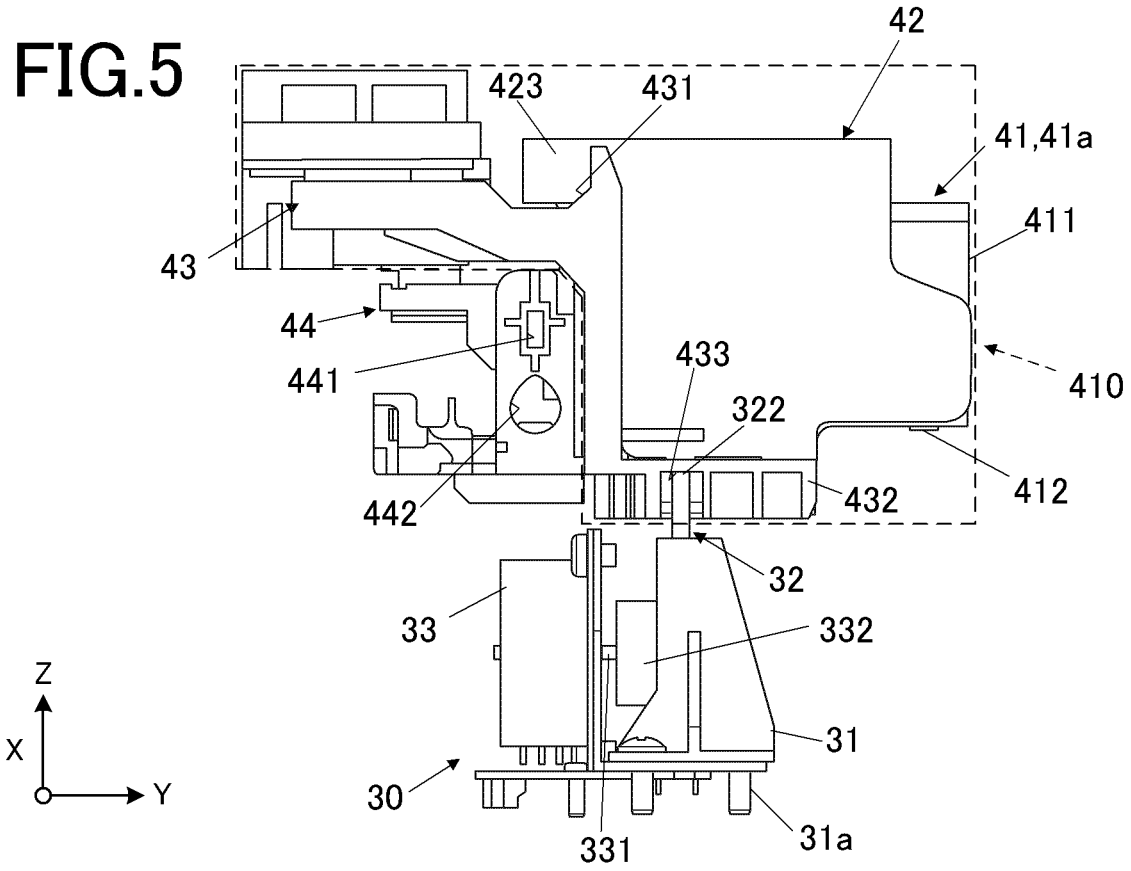
FIG. 5 is a side view of the main portion showing a stirrer, a carriage, and the surroundings according to the present embodiment.

FIG. 5 is a side view of the main portion showing the stirrer, the carriage, and the surroundings. FIG. 5 omits the illustration of the X-direction guide axis 452 included in the head movement mechanism 49.

As shown in FIG. 5, etc., the movement guide 44 includes an axis insertion hole 442 (see FIG. 5, FIG. 7) through which the X-direction guide axis 452 is inserted. The movement guide 44 moves along the X-direction guide axis 452 in a state in which the X-direction guide axis 452 is inserted through the axis insertion hole 442.

A holder retainer 43 that retains the holder 42 in which the print head 41 is mounted is fastened to the movement guide 44.

According to the present embodiment, the carriage 410 includes the tank 411 of the print head 41, the holder 42, and the holder retainer 43 (range of the carriage 410 is shown with broken lines in FIG. 5).

Figure 6:
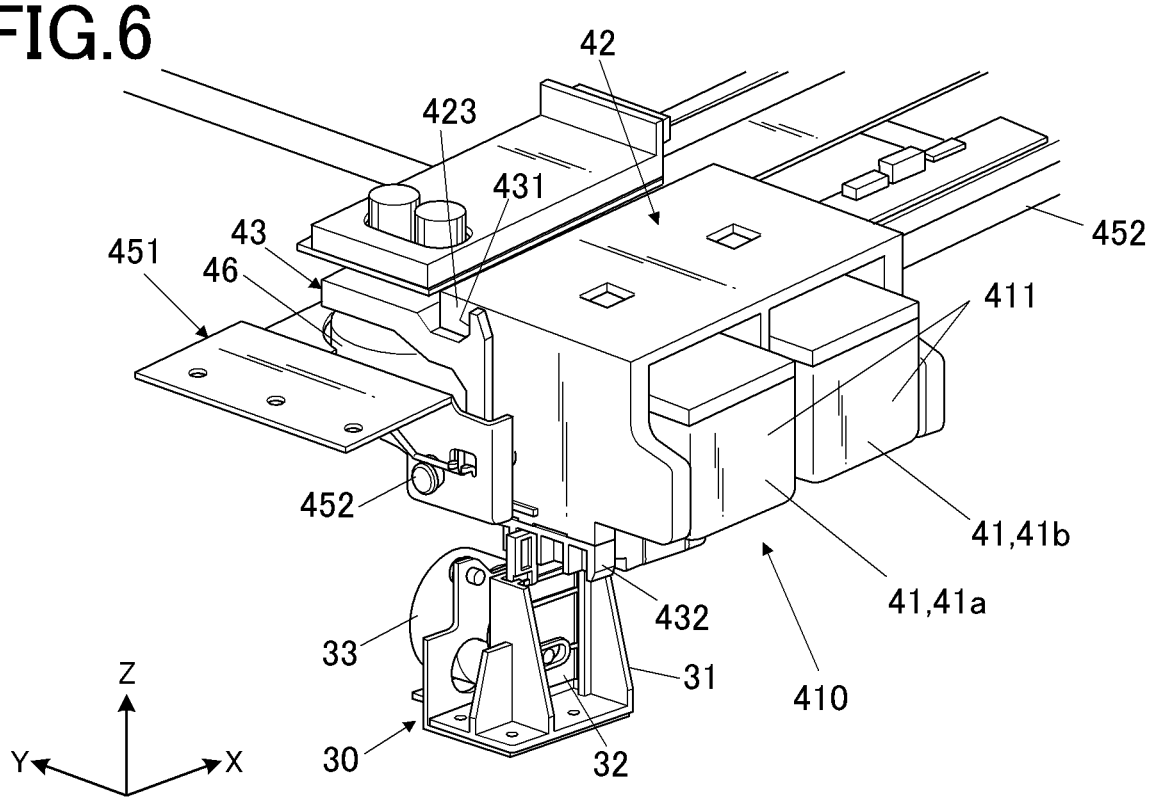
FIG. 6 is a perspective view of a main portion showing the carriage and the surrounding configuration according to the present embodiment.

FIG. 6 is a perspective view of the main portions showing the configuration of the carriage and the surroundings.

As shown in FIG. 6, a fastener 423 is provided to the rear side of the holder 42 (rear side of the apparatus in the Y-direction in FIG. 6, etc.). A fastener receiver 431 that receives the fastener 423 is provided in the holder retainer 43 on the front side of the apparatus in the Y-direction.

By fastening the fastener 423 to the fastener receiver 431, the print head 41 can be moved as one with the holder retainer 43 in a state retained in the holder 42.

Since the holder retainer 43 is fastened to the movement guide 44, the carriage 410 is attached to the conveying mechanism such as an X-direction guide axis 452 through the movement guide 44. When the X-direction movement motor 46 is operated, the carriage 410 moves along the X-direction guide axis 452 with the movement guide 44.

The movement guide 44 is made to allow a certain amount of rattling, and when the carriage 410 shakes due to the operation of the later described stirrer 30 (see FIG. 10, etc.), the fastened state is maintained so that the carriage 410 is not released from the movement guide 44. The configuration to allow a rattling in the movement guide 44 is not limited. For example, by providing an allowance in a shaking direction (up-down direction in the present embodiment) of the carriage 410 in the axis insertion hole 442 where the X-direction guide axis 452 is inserted through, the configuration is made to allow rattling.

When the carriage 410 shakes, the movement guide 44 is not released from the X-direction guide axis 452.

Specifically, as described above, the axis insertion hole 442 through which the X-direction guide axis 452 is inserted is provided in the movement guide 44, and when the stirrer 30 is fastened to the carriage 410, the movement guide 44 is fastened to the main body fastener 451*a* provided on the apparatus main body side (frame 451 in the present embodiment).

Figure 7:
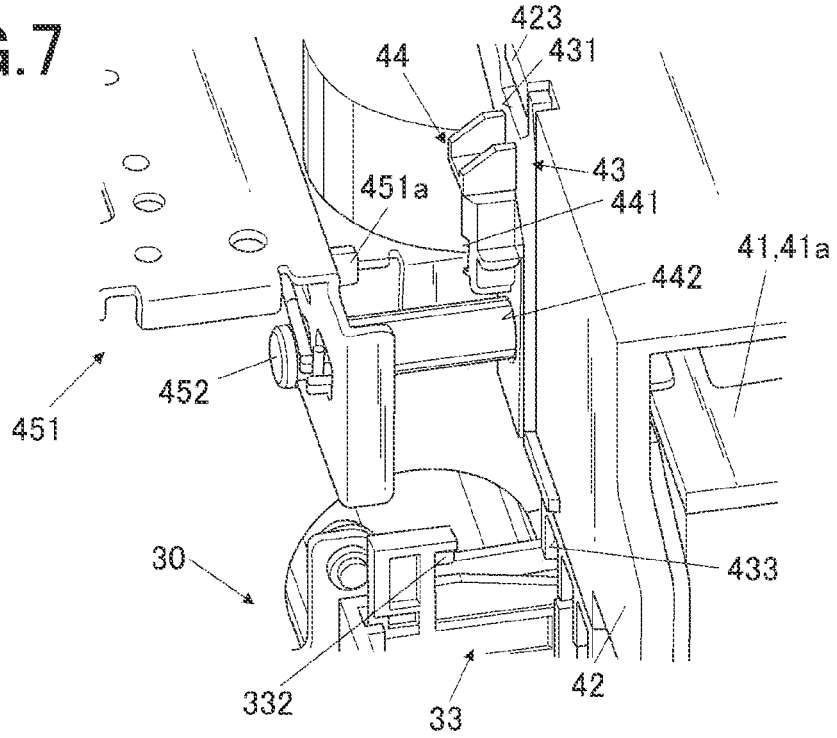
FIG. 7 is a perspective view of a main portion showing a fastened portion between a movement guide and a frame according to the present embodiment.
Figure 8:
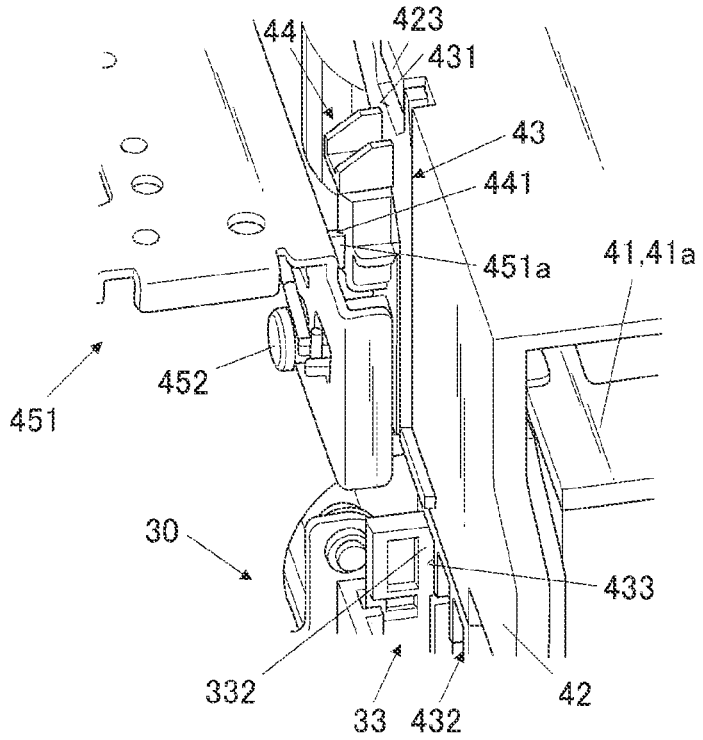
FIG. 8 is a perspective view of a main portion showing a fastened state of a fastened portion between the movement guide and the frame according to the present embodiment.
Figure 9:
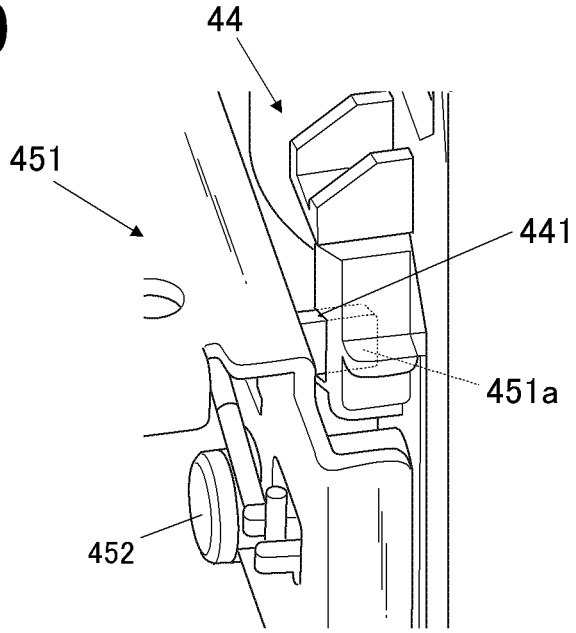
FIG. 9 is an enlarged perspective view showing the fastened portion where the movement guide and the frame are in the fastened state according to the present embodiment.

FIG. 7 is a perspective view of a main portion showing a relation of the positions between the main body fastener of the frame 451 and the movement guide. FIG. 8 is a perspective view of a main portion showing a state in which the movement guide is fastened to the main body fastener. FIG. 9 is a perspective view of a main portion in which a fastened portion between the main body fastener and the movement guide shown in FIG. 8 is enlarged.

As shown in FIG. 7 to FIG. 9, the main body fastener 451*a* according to the present embodiment is a convex portion provided in a plate metal on a side portion of the frame 451 as the apparatus main body side. A concave portion 441 which receives the main body fastener 451*a* to be fastened is provided in the movement guide 44 in a position corresponding to the main body fastener 451*a*.

When the stirring by the stirrer 30 is performed, the main body fastener 451*a* is fastened to the concave portion 441 so that the movement guide 44 does not rattle greatly with relation to the frame 451.

That is, only the carriage 410 (member within the range surrounded by a broken line in FIG. 5) shakes when the stirring is performed by the stirrer 30. Therefore, rattling does not occur in the movement guide 44.

Therefore, even if the ink is stirred and the carriage 410 (tank 411 of the print head 41 included in the carriage 410) in a state mounted on the frame 451 is shaken, the influence that the shaking of the carriage 410 caused by the stirrer 30 provides to the head movement mechanism 49 can be kept to a minimum. After the stirring, the normal conveying of the movement guide 44 and the carriage 410 fastened to the movement guide 44 becomes possible.

Here, with reference to FIG. 10 to FIG. 13, the stirrer according to the present embodiment is described.

As shown in FIG. 3 and FIG. 4, the stirrer 30 is provided on the base 20 in the stirring area Ar2, and the ink in the tank 411 can be stirred. According to the present embodiment, the stirrer 30 at least shakes the tank 411 and stirs the ink. The stirrer 30 can be provided as a configuration in which the ink is stirred by a method other than shaking the tank 411.

The stirrer 30 is in the fastened state (linked state) with the carriage 410 when the carriage 410 moves to the stirring area Ar2. The stirring is performed by shaking the tank 411 in the fastened state.

Figure 10:
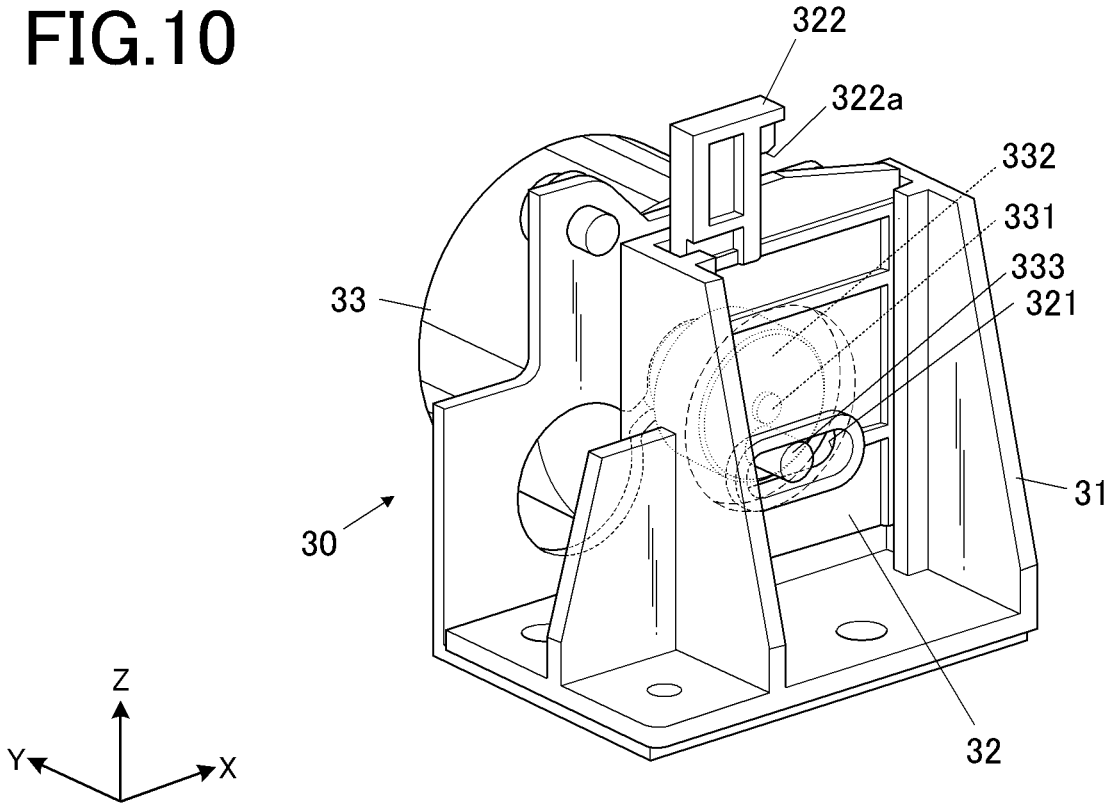
FIG. 10 is a perspective view of a stirrer according to the present embodiment.

FIG. 10 is a perspective view of a main portion showing the stirrer fastened to the carriage.

As shown in FIG. 10, the stirrer 30 includes a supporting frame 31, an elevating slider 32 supported by the supporting frame 31, a stirring motor 33 as a power source, and a motion switching mechanism (switcher) that is connected to the stirring motor 33 and that switches driving power of the stirring motor 33 from a rotating motion to a linear reciprocating motion.

Figure 11:
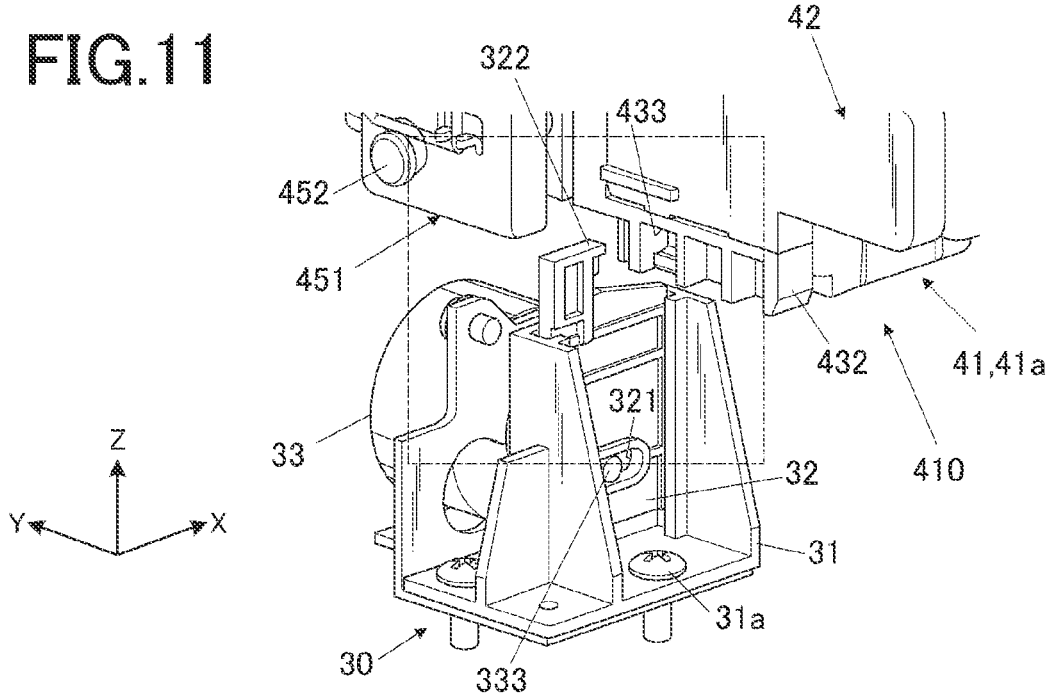
FIG. 11 is a perspective view of the main portion showing the surroundings of the fastened portion between the stirrer and the carriage according to the present embodiment.
Figure 13:
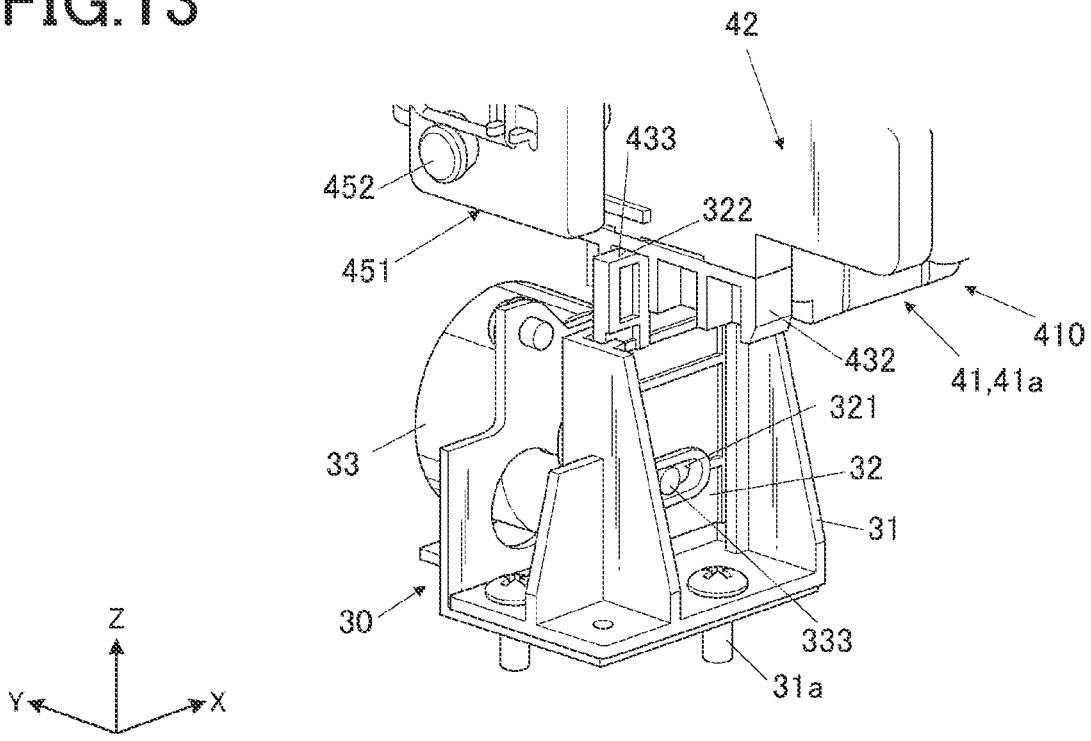
FIG. 13 is a perspective view of a main portion showing the fastened state between the stirrer and the carriage according to the present embodiment.

The supporting frame 31 is fixed on the base 20 by the screws 31*a* (see FIG. 5, FIG. 11, FIG. 13, etc.).

The elevating slider 32 is a plate shaped member supported by the supporting frame 31. The elevating slider 32 is supported by the supporting frame 31. With this, the elevating slider 32 does not rattle during the reciprocating motion in the up-down direction, and stable linear motion becomes possible.

A long hole 321 extending in the horizontal direction is formed near the center of the elevating slider 32.

A carriage fastener 322 projecting in the upward direction is provided in the upper portion of the elevating slider 32.

FIG. 11 is a perspective view of the main portion showing the surroundings of the fastened portion between the stirrer and the carriage according to the present embodiment.

As shown in FIG. 11, etc., a concave portion 433 that receives and fastens the carriage fastener 322 is formed in a retainer lower portion 432 which is a portion of the holder retainer 43 included in the carriage 410 and that supports the holder 42 from the lower side. When the carriage 410 including the tank 411 moves to the stirring area Ar2, the carriage fastener 322 is fitted in the concave portion 433 to be the fastened state, and the stirrer 30 is fastened (linked) to the carriage 410.

When the carriage fastener 322 is fastened (that is, in the fastened state), the stirrer 30 is in the fastened state with the carriage 410, and shakes the tank 411 (print head 41 including tank 411).

The carriage fastener 322 is detached from the carriage 410 due to the movement of the carriage 410 including the tank 411. The state in which the carriage fastener 322 is fastened to the carriage 410 is released by the carriage 410 moving in the direction separating from the stirring area Ar2.

Figure 12A:
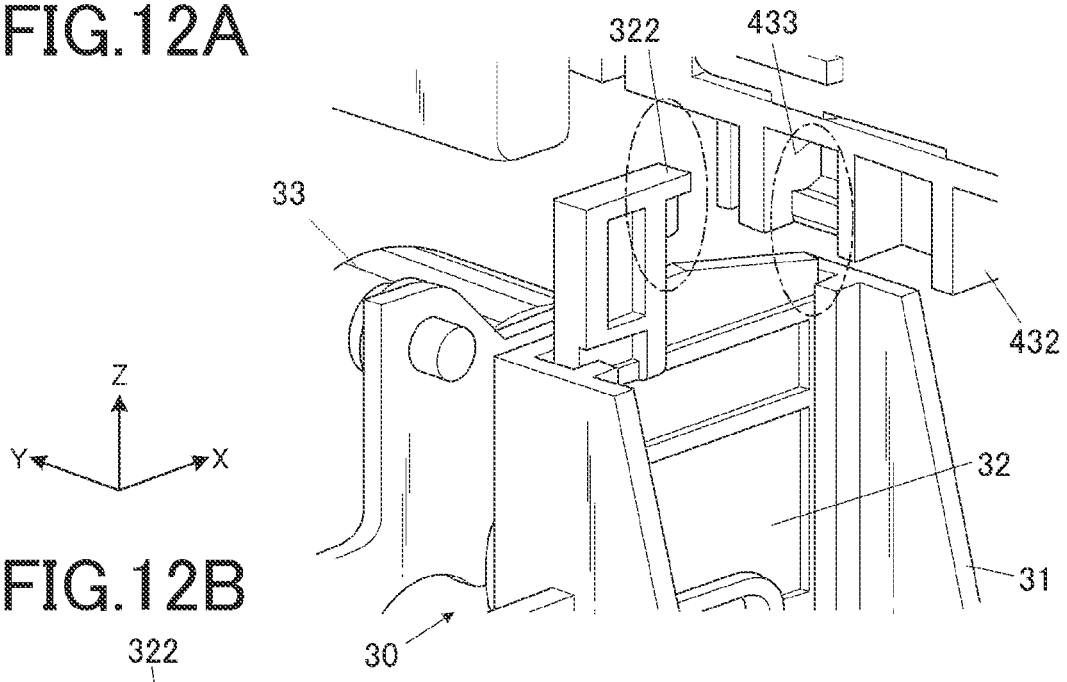
FIG. 12A is a perspective view enlarging the portion within the frame shown with a long and short dash line in FIG. 11.
Figure 12B:
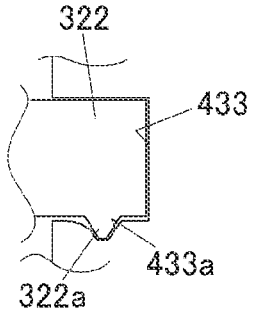
FIG. 12B is a diagram schematically showing the configuration of the fastened portion between the stirrer and the carriage.

FIG. 12A is a perspective view enlarging the inside of the frame shown with the long and short dash line in FIG. 11. FIG. 12B is a diagram schematically showing a configuration of a fastened portion between the stirrer and the carriage. FIG. 13 is a perspective view of a main portion showing the fastened state between the stirrer and the carriage according to the present embodiment.

As shown in FIG. 12B, a fastener convex portion 322*a* is provided in the carriage fastener 322, and a depressed portion 433*a* in which the fastener convex portion 322*a* is fitted is formed in the position corresponding to the fastener convex portion 322*a* in the concave portion 433. An R processing, chamfering or the like is performed on the receiving side (left side in FIG. 12B) in the depressed portion 433*a*, and the shape is formed so that the carriage fastener 322 is easily invited in the concave portion 433. The shape of the fastener convex portion 322*a* and the concave portion 433*a* is not limited to the illustrated examples.

Since the shape of the carriage fastener 322 and the concave portion 433 is formed in the above shape, the carriage fastener 322 is fastened to the concave portion 433 to be the fastened state (see FIG. 13) easily and smoothly by simply moving the carriage 410 to the stirring area Ar2. Therefore, it is possible to prevent the stirrer 30 from being released from the carriage 410 when the stirring is performed. When the carriage 410 moves in a direction that separates from the stirring area Ar2, the carriage fastener 322 is easily released from the concave portion 433, and the fastened state is released.

As described above, when the stirrer 30 and the carriage 410 are in the fastened state, the main body fastener 451*a* provided on the frame 451 side is fastened to the concave portion 441 provided on the movement guide 44 (see FIG. 8). Therefore, according to the present embodiment, it is possible to suppress the influence of the vibration of the stirring by the stirrer 30 spreading to other units of the conveying mechanism such as the X-direction guide axis 452.

The stirring motor 33 is a driving source of the stirrer 30 and includes an output shaft 331 that rotates by the rotation of the motor. The rotating direction of the stirring motor 33 may be clockwise or counter clockwise. The rotating speed of the motor is suitably set. The effect of stirring is considered to be higher as the rotating speed becomes faster. However, the noise of the motor becomes larger as the rotating speed becomes faster. Therefore, the rotating speed of the stirring motor 33 is determined according to the situation of use. The rotating speed may be constant or may be variable.

The axis receiving member 332 including an eccentric shaft 333 eccentric to the output shaft 331 is attached to the output shaft 331 of the stirring motor 33.

The free end of the eccentric shaft 333 is provided in the long hole 321 of the elevating slider 32. When the eccentric shaft 333 moves in the long hole 321 according to the rotation of the stirring motor 33, the elevating slider 32 moves linearly in an up-down direction.

According to the present embodiment, the axis receiver 332 including the eccentric shaft 333 and the elevating slider 32 including the long hole 321 constitute the motion switching mechanism that switches the driving force of the stirring motor 33 from the rotating motion to the linear reciprocating motion.

The present embodiment describes an example employing a Scotch Yoke mechanism as the motion switching mechanism, but the configuration is not limited to the above as long as the motion switching mechanism is able to switch the driving force of the stirring motor 33 from the rotating motion to the linear reciprocating motion. For example, other mechanisms such as a slider-crank mechanism is employed as the motion switching mechanism.

As shown in FIG. 5, even when the carriage fastener 322 is fastened to the concave portion 433, and the stirrer 30 is in the fastened state with the carriage 410, the X-direction guide axis 452 included in the head movement mechanism 49 is only inserted through the axis insertion hole 442 of the movement guide 44. Therefore, the carriage 410 including the tank 411 that shakes by the stirring is not directly fastened to the conveying mechanism such as the X-direction guide axis 452, etc. Therefore, the head movement mechanism 49 hardly receives the influence of shaking by stirring, and the highly accurate conveying operation can be performed after the stirring.

The control apparatus 80 mounted on the printing apparatus 100 is a computer including a controller 81 (see FIG. 2) that includes a processor such as a CPU (Central Processing Unit) (not shown), and a storage 82 (see FIG. 2) that includes a ROM (Read Only Memory) 821 and a RAM (Random Access Memory) 822.

According to the present embodiment, the controller 81 mainly functions as an image controller 811, a stirring controller 812, a printing controller 813, and the like.

The storage 82 is a nonvolatile storage medium that stores a program executed by the controller 81. The storage 82 stores various programs and various data to operate the printing apparatus 100. The functions such as the image controller 811, the stirring controller 812, the printing controller 813, and the like by the controller 81 is realized by the CPU of the controller 81 in coordination with the program stored in the ROM 821 of the storage 82.

The printing apparatus 100 includes an imaging apparatus 51 and a lighting apparatus 52, and the image controller 811 controls the operation of the imager 50.

The imaging apparatus 51 is a compact camera including a solid state imaging element including 2 million pixels or more and a lens, for example. The lighting apparatus 52 is an illuminating light such as white LED, for example.

The imager 50 illuminates the fingernail positioned in the printing area Ar1 with the lighting apparatus 52. Then, the finger is imaged with the imaging apparatus 51, and the nail image that is the image of the fingernail is obtained.

The image data of the image imaged by the imager 50 is obtained by the image controller 811 and stored in the storage 82. When the printing apparatus 100 is provided with the communicator that is able to communicate with the external terminal apparatus (not shown), the nail image obtained by the imager 50 can be sent to the terminal apparatus through the communicator.

The stirring controller 812 controls the operation of the stirring motor 33 of the stirrer 30, and stirs the ink contained in the tank 411. The stirring time (that is, the amount of time the stirring motor 33 is operated and the stirring is performed) and the rotating speed of the stirring motor 33 during stirring is suitably set depending on the state of use.

The stirring time and the rotating speed may be set according to the instruction input on the operator 12, etc. or the above may be suitably set by the stirring controller 812 considering the state of use of the ink (for example, amount of time that elapsed from the previous printing, amount of time that the ink is placed still), the type of ink that is the target of stirring, the amount of remaining ink, and the like. A predetermined value may be set as a default value.

The stirring by the stirrer 30 may be performed according to the input of the operation instruction on the operator 12, or the stirring controller 812 may control the operation to be performed at a predetermined timing such as before the start of the printing.

The printing controller 813 controls the printer 40 to perform the printing process.

Specifically, based on the print data, the operation of each motor (X-direction movement motor and Y-direction movement motor) of the head movement mechanism 49 is controlled, and the operation of the discharger 412 of the print head 41 (base head 41*a* and design head 41*b*) is controlled to suitably discharge the drops of ink.

The control apparatus 80 may function as the detector of the nail information that analyzes the image of the nail image obtained by the imager 50 and detects a range of a nail (that is, nail outline) that is the printing target. The control apparatus 80 may also function as the generator of the print data that fits the desired nail design in the nail outline and generates the print data. Various correction processes can be performed on the print data. The detection of nail information, the generating of print data, the correction process of the print data, and the like can be performed with an external terminal apparatus, and the control apparatus 80 of the printing apparatus 100 can receive the final print data and perform the printing process.

Next, the operation of the printing apparatus 100 according to the present embodiment and the printing control method are described.

When printing is performed with the printing apparatus 100, the print data to print the desired nail design on the nail is prepared. Then, when an instruction to start printing is input on the operator 12, the controller 81 operates the Y-direction movement motor 48 of the head movement mechanism 49 and the frame 451 of the X-direction movement mechanism 45 is moved to the apparatus close side in the Y-direction (for example, the state shown in FIG. 3).

When the frame 451 moves to the most front part in the Y-direction, next, the controller 81 operates the X-direction movement motor 46, and the carriage 410 (that is, the holder 42 in which the print head 41 including the tank 411 is mounted) in the frame 451 is moved to the stirring area Ar2. According to the present embodiment, the carriage 410 is moved to the left end in the X-direction (for example, state shown in FIG. 4).

When the carriage 410 moves to the stirring area Ar2, due to this movement, the carriage fastener 322 provided in the elevating slider 32 of the stirrer 30 is fastened to the concave portion 433 provided in the retainer lower portion 432, and the stirrer 30 is in the fastened state with the carriage 410 (see FIG. 13, etc.).

The main body fastener 451*a* provided in the frame is received by the concave portion 441 of the movement guide 44 fastened to the holder 42, and the movement guide 44 is fastened to the frame 451 which is the mechanism on the apparatus main body side (see FIG. 6, FIG. 8, etc.). In this state, the stirring controller 812 operates the stirring motor 33 of the stirrer 30, and the tank 411 is shaken. With this, the stirring of the ink in the tank 411 is performed.

FIG. 14A to FIG. 14D are front views of the stirrer showing an operation of the elevating slider in the stirrer.

Figure 14A:
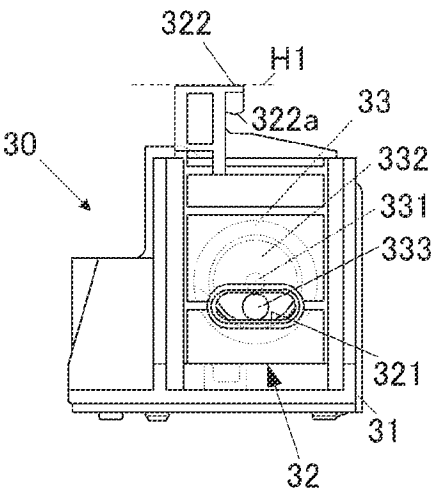
FIG. 14A is a front view of a stirrer describing the operation of the stirrer according to the present embodiment.

FIG. 14A shows a state in which the eccentric shaft 333 provided in the long hole 321 of the elevating slider 32 is to be in the lowest position. The height of the upper end of the elevating slider 32 (that is, the upper end of the carriage fastener 322 fastened to the carriage 410) is in a position "H1" shown with a broken line.

Figure 14B:
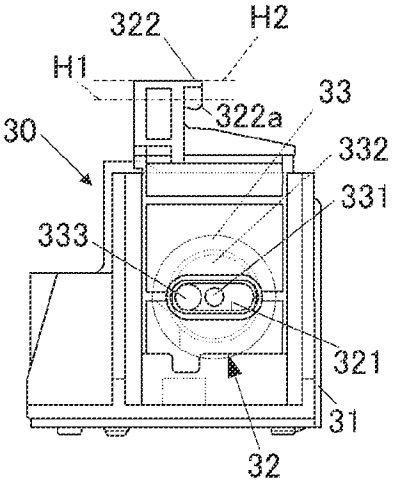
FIG. 14B is a front view of a stirrer describing the operation of the stirrer according to the present embodiment.

FIG. 14B shows the stirring motor 33 rotated 90 degrees clockwise from the state shown in FIG. 14A. The eccentric shaft 333 moves to the left end in the long hole 321, and the entire elevating slider 32 is pushed up to the extent that the position of the height of the eccentric shaft 333 increased. The height of the upper end of the elevating slider 32 (upper end of the carriage fastener 322) is in a position "H2" shown with a broken line, and the position is higher than state "H1" shown in FIG. 14A (shown by the long and short dash line in FIG. 14B).

Figure 14C:
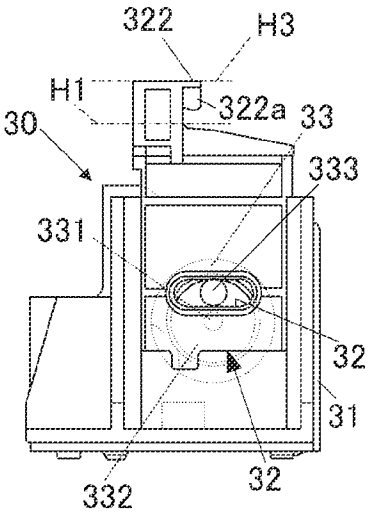
FIG. 14C is a front view of a stirrer describing the operation of the stirrer according to the present embodiment.

FIG. 14C shows a state in which the stirring motor 33 is further rotated 90 degrees (180 degrees from the state shown in FIG. 14A) clockwise from the state shown in FIG. 14B. The eccentric shaft 333 here moves to the center of the long hole 321, and the position of the height of the eccentric shaft 333 becomes the highest. The entire elevating slider 32 is further pushed up in the extent that the position of the height of the eccentric shaft 333 is raised, and the height of the upper end of the elevating slider 32 (upper end of the carriage fastener 322) at this time is in a position of "H3" shown with a broken line, and the position is highest compared to the state "H1" shown in FIG. 14A (shown by the long and short dash line in FIG. 14C).

Figure 14D:
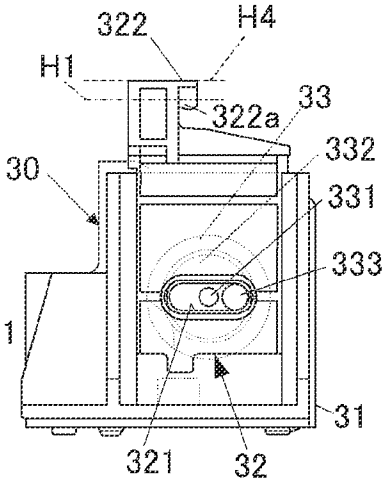
FIG. 14D is a front view of a stirrer describing the operation of the stirrer according to the present embodiment.
Figure 14D:
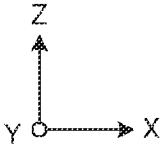

FIG. 14D shows a state in which the stirring motor 33 is further rotated 90 degrees (270 degrees from the state shown in FIG. 14A) clockwise from the state shown in FIG. 14C. The eccentric shaft 333 here moves to the right end of the long hole 321, and the position of the height of the eccentric shaft 333 becomes the same height as FIG. 14B. When the position of the height of the eccentric shaft 333 becomes lower than the state in FIG. 14C, the entire elevating slider 32 becomes lower. The height of the upper end (upper end of the carriage fastener 322) of the elevating slider 32 at this time is a position "H4" shown with a broken line, and becomes the same height as the state "H2" shown in FIG. 14B.

Then, when the stirring motor 33 is further rotated 90 degrees clockwise, the position of the height of the eccentric shaft 333 returns to the state shown in FIG. 14A, and the height of the upper end of the elevating slider 32 (upper end of the carriage fastener 322) is lowered to the state shown in FIG. 14A. By repeating such operation, the elevating slider 32 repeats the vertical movement, the carriage 410 fastened to the elevating slider 32 shakes (vibrates) vertically, and the stirring of the ink in the tank 411 is performed.

According to the present embodiment, the tank 411 and the discharger 412 included in the carriage 410 are provided as one. Therefore, when the tank 411 is shaken, the drops of ink may fall from the discharger 412 or the ink in the mist form may be scattered. Here, the ink receiver 22 is provided in the stirring area Ar2. Therefore, the drops of ink, etc. that fall from the discharger 412 is received by the ink receiver 22, and the inside of the apparatus is not stained.

When the ink stirring is performed for a predetermined amount of time, the controller 81 stops the stirring and progresses to the printing.

After the stirring is performed, maintenance of the print head 41 may be performed before progressing to the printing. The contents of the maintenance may be, for example, to forcibly discharge ink from the discharger 412 to the ink receiver 22 in order to adjust the state of the nozzle of the discharger 412. Alternatively, for example, if the maintenance area is provided separately, the print head 41 may be moved to the maintenance area after the stirring and before the printing, and the maintenance operation such as purging and wiping may be performed.

In the printing, the controller 81 operates each motor of the head movement mechanism 49 (X-direction movement motor 46 and Y-direction movement motor 48). The print head 41 is moved to the printing area Ar1. The ink is discharged from the discharger 412 of the print head 41 according to the print data and the printing is performed on the nail surface.

According to the present embodiment, the base ink is discharged from the base head 41*a*, and the base layer is formed on the nail surface. The white color component, etc. in the base ink easily separates and settles. By performing the stirring by the stirrer 30, the white color component is dispersed substantially evenly. Therefore, it is possible to form the base layer with a beautiful finish without unevenness in the density. Since the entire tank 411 including the holder 42 is stirred (shaken), the effect of stirring is higher than methods such as vibrating.

After the base layer is formed, the controller 81 discharges the design ink of each color from the design head 41*b* onto the base layer, and the printing of the nail design is performed. With this, the printing process ends.

According to the above embodiment, the design can be printed on the base layer without unevenness in the density. Therefore, the nail print can be performed with high quality.

As described above, according to the present embodiment, the printing apparatus 100 at least includes the carriage 410 including the tank 411 that contains ink, the head movement mechanism 49 that functions as the driver that moves the tank 411, and the stirrer 30 that is provided in the stirring area Ar2 provided outside of the printing area Ar1 in the apparatus, and that is capable of stirring ink in the tank 411. The stirrer 30 is to be in the fastened state with the carriage 410 when the carriage 410 moves to the stirring area Ar2, and the ink in the tank 411 is stirred.

With this, the stirring of the ink can be performed automatically without causing trouble to the user. When the stirring is performed, the carriage 410 is moved to the stirring area Ar2, and is set to the fastened state fastened to the stirrer 30. With this, the ink in the tank 411 can be stirred without moving the stirrer 30 itself. Therefore, it is possible to avoid the apparatus from becoming large, and the operation can be performed without the motor of the head movement mechanism 49 being a motor with high output.

Then, since the stirring of ink can be suitably performed in the printing apparatus 100, even if the printing is performed using the ink including the solute having high specific gravity such as titanium oxide (base ink such as white according to the present embodiment), the ink can be stirred without taking out the tank 411 outside of the apparatus, and it is possible to maintain the suitable state in which the density unevenness does not occur. Therefore, it is possible to perform high quality printing stably.

According to the present embodiment, the stirrer 30 at least shakes the tank 411 and stirs the ink in the tank 411.

Therefore, the stirring of the ink can be performed effectively.

According to the present embodiment, the apparatus further includes the discharger 412 that discharges ink contained in the tank 411, and the tank 411 is formed as one with the discharger 412.

When the print head 41 is a cartridge type formed as one, there is no need for a configuration such as connecting the tank with the discharger using a supply pipe, and the configuration of the apparatus can be simplified.

According to the present embodiment, an ink receiver 22 that receives drops of ink generated from the ink discharger 412 is provided in the stirring area Ar2 of the apparatus.

When the print head 41 that is a cartridge type formed as one is stirred, the drops of ink may fall from the discharger 412 during the stirring or after the stirring. Since the ink receiver 22 is provided, the apparatus is not stained even if the drops of ink fall.

According to the present embodiment, the stirrer 30 includes the carriage fastener 322 that detaches from the carriage 410 according to the movement of the carriage 410 including the tank 411. When the carriage fastener 322 is in the fastened state, the stirrer 30 is in the fastened state with the carriage 410 and the tank 411 is shaken. With this, the ink in the tank 411 is stirred.

Consequently, the fastening and the release between the stirrer 30 and the carriage 410 can be performed by only the movement of the carriage 410 without providing a complicated configuration separately.

According to the present embodiment, the carriage 410 is fastened to the movement guide 44 that moves along the X-direction guide axis 452, and moves with the movement guide 44. The movement guide 44 is fastened to the main body fastener 451*a* provided in the frame 451 which is a mechanism on the apparatus main body side when the carriage fastener 322 is in the fastened state.

As described above, by attaching the carriage 410 indirectly to the head movement mechanism 49 through the movement guide 44, the vibration to the movement guide 44 is suppressed when the carriage 410 is shaken by the stirring, and it is possible to suppress the influence on the head movement mechanism 49. Therefore, when the stirring is performed in the apparatus, the conveying can be maintained with high accuracy.

Since the movement guide 44 is fastened to the frame 451 when the stirring is performed, it is possible to prevent the movement guide 44 from being released or being displaced from the X-direction guide axis 452 due to the vibration caused by stirring.

According to the present embodiment, the stirrer 30 includes a stirring motor 33 and the motion switching mechanism that switches the driving force of the stirring motor 33 to the linear reciprocating motion from the rotating motion. The tank 411 is shaken by the driving force of the stirring motor 33 switched to the linear reciprocating motion by the motion switching mechanism.

With this, the tank 411 can be shaken effectively even in the small apparatus, and the ink can be stirred sufficiently.

In the maintenance process, the maintenance of the print head can be performed at least after the stirring and before progressing to the printing.

Therefore, even if the discharger 412 is formed as one with the tank 411 to be the print head 41 and the drops of ink may jump out from the discharger 412 when the tank 411 is shaken, the printing can be performed in a suitable state. With this, high quality printing can be performed.

The embodiments of the present invention are described above, but the present invention is not limited to the above embodiments, and various modifications are possible without leaving the scope of the invention.

For example, according to the present embodiment, it is described that the motion switching mechanism that switches the driving force of the stirring motor 33 to a linear reciprocating motion from the rotating motion switches the rotating motion to the linear reciprocating motion in the up-down direction. Alternatively, the motion switching mechanism may switch the rotating motion to a linear reciprocating motion in a left-right direction.

According to the present embodiment, the stirrer 30 includes the stirring motor 33, but the motor that is to be the driving source of the stirrer 30 is not limited to the stirring motor 33.

For example, the motor provided in the head conveying mechanism 49 (for example, X-direction movement motor 46), etc. may operate as the driving source of the stirrer 30. In this case, the number of motors provided in the apparatus can be reduced and the apparatus can be made further smaller and lighter.

The stirring area Ar2 is to be the area outside of the printing area Ar1, and the position is not limited to the position described in the above embodiments.

For example, the area that is to the left side end in the X-direction and that is to the rear of the apparatus can be the stirring area Ar2 in which the stirrer 30 is provided.

Moreover, according to the present embodiment, the ink receiver 22 is provided in the stirring area Ar2, but the ink receiver 22 does not have to be provided.

For example, when the stirring area Ar2 is provided in the rear of the apparatus as described above, the maintenance unit that performs maintenance of the print head 41 can be provided in or around the stirring area Ar2. For example, the maintenance unit includes a purge that receives ink forcibly discharged from the nozzle and a wiper that wipes the discharger 412 and removes the ink attached to the nozzle opening. The purge described above may function as the ink receiver that collects the drops of ink and the ink in the mist form generated by the stirring.

According to the present embodiment, the printing apparatus 100 includes both the base head 41*a* and the design head 41*b* but the printing apparatus is not limited to the above. For example, the printing apparatus may be an apparatus dedicated to printing the base, and may only include the base head 41*a* in which the base ink that needs to be stirred by the stirrer 30 is contained. In this case, after the base is printed, the finger is inserted in the printing apparatus that includes the design head that prints with various color inks (that is, design ink) and the printing of the nail design is performed.

According to the present embodiment, the base head 41*a* and the design head 41*b* are held in one holder 42, and the above are moved as one. However, the configuration of the printer 40 is not limited to the above.

For example, the base head 41*a* and the design head 41*b* may be held in separate holders, and may be configured to be able to move separately. In this case, if the ink that needs to be stirred is only the base ink, only the tank in which the base ink is contained is to be stirred by the stirrer 30 and only the holder in which the base head 41*a* is held is fastened to the stirrer 30 and stirred when the stirring is performed.

According to the present embodiment, the printing is completed by using only the printing apparatus 100. However, the printing apparatus 100 is not limited to the apparatuses described above.

For example, a print system can be configured linked with an external terminal apparatus (smartphone, tablet, or the like). In this case, most of the processes other than the stirring of ink and the printing such as the selection of the nail design and the generating of the print data can be performed on the external apparatus side such as the terminal apparatus.

Although various embodiments have been described, the scope of the present invention is not limited to the embodiments described above, and the scope of the invention is limited only by the appended claims and its equivalents.

What is claimed is:

1. A printing apparatus comprising:

a carriage which is capable of holding at least one tank containing ink and which performs printing in a printing area in the apparatus;

a driver which moves the carriage between at least the printing area and a stirring area provided outside the printing area; and a stirrer which is provided in the stirring area and which is capable of stirring the ink in the tank, wherein, the stirrer is in a fastened state with the carriage in response to the driver moving the carriage to the stirring area, and stirs the ink in the tank in the fastened state.

2. The printing apparatus according to claim 1 wherein the stirrer at least shakes the tank.

3. The printing apparatus according to claim 1, wherein the stirrer includes a carriage fastener which is fastened and unfastened from the carriage by movement of the carriage, and the stirrer is in the fastened state with the carriage and shakes the tank in response to the carriage fastener fastening the carriage.

4. The printing apparatus according to claim 3, wherein the carriage is fastened to a movement guide which moves along a guide axis and the carriage moves with the movement guide, and the movement guide is fastened to a main body fastener provided on an apparatus main body side in response to the stirrer being in the fastened state with the carriage.

5. The printing apparatus according to claim 1, further comprising a discharger which discharges the ink contained in the tank, wherein the tank and the discharger are formed as one.

6. The printing apparatus according to claim 5, further comprising in the stirring area, an ink receiver which receives drops of ink generated from the discharger.

7. The printing apparatus according to claim 1, wherein the stirrer includes a motor and a motion switcher which switches driving force of the motor to a linear reciprocating motion from a rotating motion, and the tank is shaken by the driving force of the motor switched to the linear reciprocating motion by the motion switcher.

8. A printing control method comprising:

moving a print head which includes a carriage which is capable of holding at least one tank containing ink, and a discharger which discharges the ink in the tank between at least a printing area and a stirring area provided outside the printing area, wherein the carriage and the discharger are formed as one, stirring the ink in the tank by a stirrer shaking the print head in the stirring area, and performing printing with the print head in the printing area, wherein, in the stirring, the stirrer is in a fastened state with the print head in response to the driver moving the print head to the stirring area, and the ink in the tank is stirred in the fastened state.

9. The printing control method according to claim 8, further comprising performing maintenance of the print head, wherein, the maintenance is performed at least after the stirring and before progressing to the printing.

10. A non-transitory computer-readable storage medium having a program stored thereon for controlling a computer used in a printing apparatus including a carriage which is capable of holding at least one tank containing ink and which performs printing in a printing area in the apparatus; a driver which moves the carriage between at least the printing area and a stirring area provided outside the printing area; and a stirrer which is provided in the stirring area and which is capable of stirring the ink in the tank, wherein the program controls the computer to perform:

stirring of the ink in the tank in response to the driver moving the carriage to the stirring area and the stirrer is in a fastened state with the carriage.

* * * * *